United States Patent [19]

Kesinger et al.

[11] 3,972,460

[45] Aug. 3, 1976

[54] PAPER TRANSPORT MECHANISM

[75] Inventors: Donald E. Kesinger, Largo; Michael B. Aaron, St. Petersburg, both of Fla.

[73] Assignee: NCR Corporation, Dayton, Ohio

[22] Filed: Mar. 24, 1975

[21] Appl. No.: 561,383

[52] U.S. Cl. ..... 226/6; 226/85; 226/153; 226/181

[51] Int. Cl.[2] ..... B65H 17/38

[58] Field of Search ..... 226/6, 76, 84, 85, 153, 226/181

[56] References Cited

UNITED STATES PATENTS

| | | | |
|---|---|---|---|
| 776,723 | 12/1904 | Casler | 226/153 X |
| 1,472,964 | 11/1923 | Donnell | 226/153 |
| 2,079,223 | 5/1937 | Murdock | 226/85 X |
| 2,513,093 | 6/1950 | Hageman | 226/153 X |
| 3,028,063 | 4/1962 | Busch | 226/76 |
| 3,358,892 | 12/1967 | Johnson | 226/85 |

*Primary Examiner*—Richard A. Schacher
*Attorney, Agent, or Firm*—J. T. Cavender; Wilbert Hawk, Jr.; George J. Muckenthaler

[57] ABSTRACT

A drive roller and cooperating idler rollers of the friction type are combined to transport or to advance paper or like record media wherein the idler rollers are driven slightly faster than the drive roller. The drive roller has slots or voids in the periphery thereof aligned with the path of travel of the idler rollers to permit an easing or relaxing of the idler roll pressure on the paper and thereby enable the canceling of any accumulated difference in the drive motion between the drive roller and the idler rollers.

13 Claims, 6 Drawing Figures

PAPER TRANSPORT MECHANISM

BACKGROUND OF THE INVENTION

In the design of a paper or like record media transport system for high speed operation, one of the parameters to be considered is that of the noise level. This is especially important in the area of thermal printing wherein a passive platen is utilized to enable minimizing of movement of parts for such high speed operation, the platen remaining in constant contact with the print head during the printing operation and during advancing of the paper. In many cases the existing art has provided for retraction of the platen a slight amount at the moment of paper feed, resulting in complicated intermittent motion and high noise levels. It is therefore desirable to reduce both the complexity of the mechanism and the noise levels, wherein either fan fold or roll-type paper can be fed against the friction of the passive platen, the drive being adaptable for use with paper having edge perforations for sprocket drive or for use with roll type paper. In the case of the common sprocket drive, transporting the paper with a passive platen would cause feeding problems such as tear out of the perforations because of the high friction against the paper.

SUMMARY OF THE INVENTION

The present invention relates to the transport or feeding of paper or like record media and more particularly to the advancing of paper past a platen and the adjacent printing mechanism, wherein such printing mechanism includes a portion or portions thereof which are in constant contact with the paper during the printing operation and during the advancing of the paper. In a specific type of printing mechanism there may be utilized a thermal printer wherein the head is in such constant contact with the paper and the printing is accomplished by actuation of thermal elements which may be arranged in matrix manner. Also in the case of fan fold paper having edge perforations and driven by means of sprockets with pins for engaging with the perforations, a frictional drive is combined with the sprocket drive, the frictional drive being a pair of idler rolls directly engageable with the paper and pressing against a drum or cylinder type platen drive member carrying the sprocket wheels. The transport mechanism, therefore, combines the idler rollers with the sprocket drive to maintain paper movement in synchronism therebetween.

In a preferred construction, the diameter of the drive drum or cylinder is slightly greater than the pitch diameter of the sprocket teeth on the ends of the drum. As the drive drum is rotated at a certain speed, the paper is caused to be driven by the pinch or idler rollers slightly faster than that determined by the speed of the sprocket teeth which action results in an accumulation of difference in speed or drive motion between the drive cylinder and the pinch rolls. This accumulation of differential motion is then canceled by providing slots or voids in the periphery of the drum and aligned with the path of travel of the pinch rolls whereby at an interval of at least once each revolution of the drive drum, the pressure of the pinch rolls against the paper and the drive drum is eased or relaxed to allow the sprocket teeth to catch up and cancel out the accumulated difference, the action providing an additive-subtractive effect for each revolution of the sprocket drive drum.

The circumference of the drive drum is equal to that of one of the fan folds of the paper to simplify the timing technique so that at the moment of pinch roll pressure relief or relaxing from the frictional drive, the transition is made from the most recently printed form to the beginning of the next successive form. The paper transport mechanism feeds the paper against increased friction to maintain the paper in a taut condition to enable the use of a passive platen and the advantages thereof for a thermal type printer.

In view of the above discussion, the principal object of the present invention is to provide mechanism to simplify the intermittent motion of advancing paper in maintaining tautness thereof.

Another object of the present invention is to provide paper advance mechanism wherein the noise level is reduced during the feeding operation of the paper.

An additional object of the present invention is to provide a combined positive drive and a frictional drive for smoothly advancing the paper in printing operations.

A further object of the present invention is to provide a combined positive drive and a frictional drive for advancing paper when utilizing the passive platen concept.

Additional advantages and features of the present invention will become apparent and fully understood from a reading of the following description taken together with the annexed drawing, in which.

Figure 1:
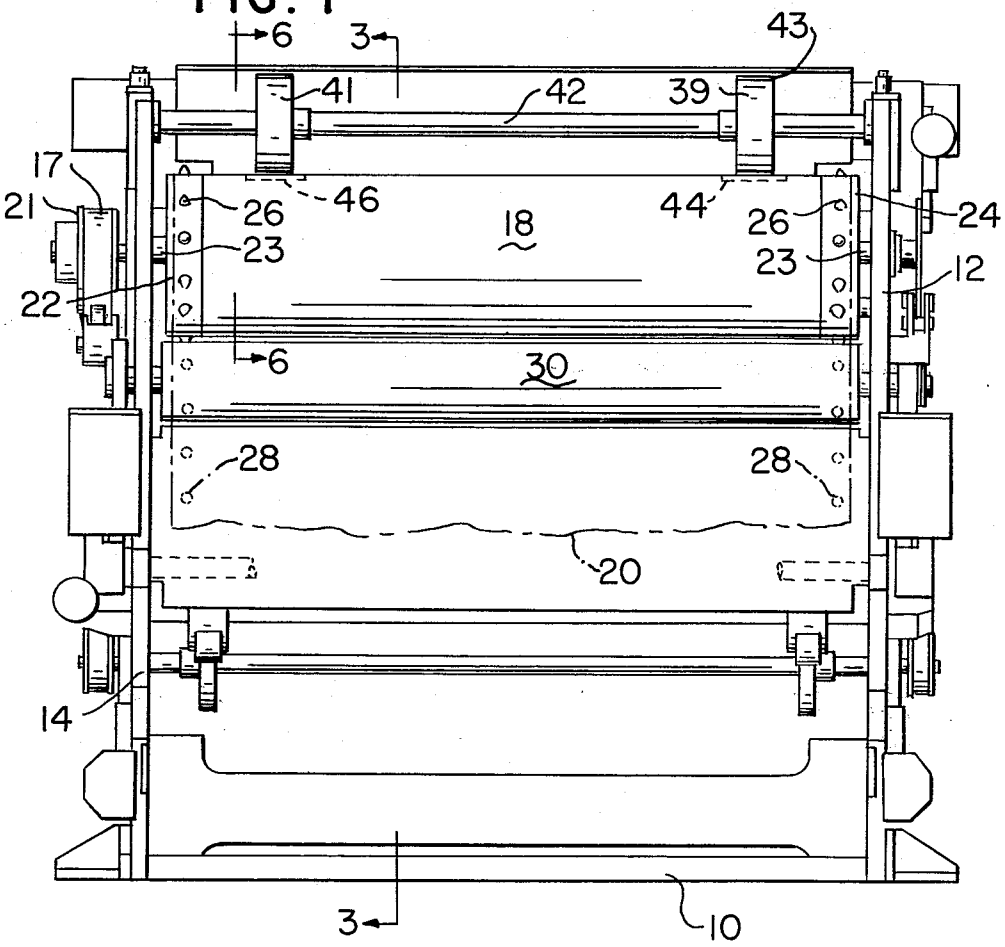
FIG. 1 is a front elevational view of a business machine incorporating the subject matter of the present invention.
Figure 2:
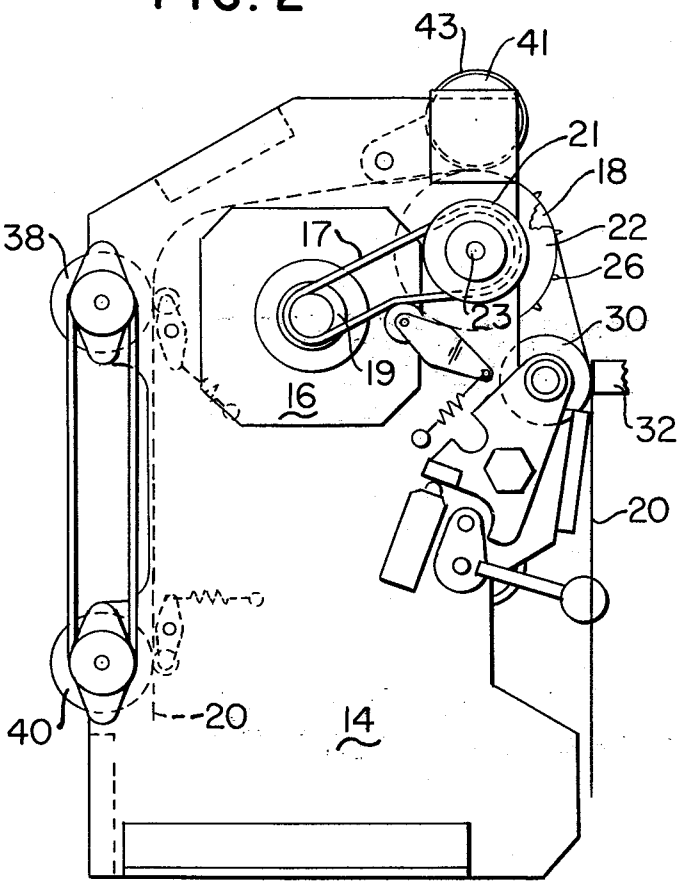
FIG. 2 is a left hand side elevational view of the machine shown in FIG. 1.

Referring now to FIGS. 1 and 2, there is shown a front and a side elevational view of certain structure of a printer which includes a base 10, side frame members 12 and 14 suitably connected together by means of straps and bars or the like, the structure supporting a drive motor 16 for driving a drum or roller 18 around which paper or like record media 20 is caused to be advanced, the drum having a shaft 23 being suitably journaled in frame members 12 and 14. The drum or roller 18 may be fabricated to drive roll-type paper or it may be suitably structured with sprocket wheels at the ends thereof for use with apertured paper which includes the apertures along the sides or edges thereof, such apertured paper being of the common fan-fold type. While a preferred type of mechanism may be for the use of the fan-fold paper, a pair of sprocket wheels 22 and 24 have pins 26 spaced on the order of one-half inch intervals around each of the wheels 22 and 24 for engaging with apertures 28 in the paper 20. A timing belt 17 connects the motor pulley 19 and the drum pulley 21, both of which are constructed to be of the toothed type to receive the belt 17.

Generally, a paper transport or drive mechanism for a high speed printer must be designed for operation at low noise levels, and as may be common practice in the case of a thermal type printer, a passive platen is utilized wherein the print head is maintained in constant contact with the paper on the platen. It is, therefore, an important aspect of the design to provide a paper transport or drive mechanism which advances the paper smoothly and in a tensioned or taut condition without tearing the perforated holes or apertures 28 in the paper by reason of high frictional forces between the print head 32 and the platen 30. It is anticipated that the sprocket wheels 22 and 24 are a separate part from the cylinder 18, as shown in FIG. 1.

Figure 3:
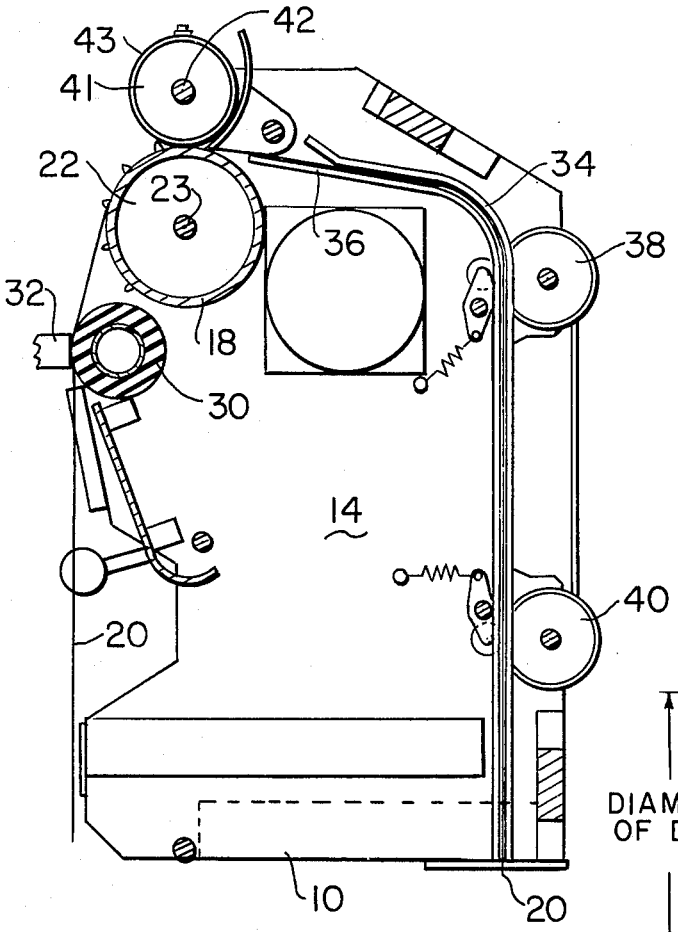
FIG. 3 is a sectional view taken on the plane 3—3 of FIG. 1.

The paper 20 is directed in an upward path at the front of the machine past the printing station which basically comprises a platen 30 and a print head 32, around the drive drum or roller 18 and rearwardly and downwardly between guide members 34 and 36 (FIG. 3), the paper then to be deposited or further processed. Tension means may be provided in the manner of rollers 38 and 40 suitably journaled and appropriately belt driven and engageable with the paper 20 as it travels down the guide members 34 and 36. It should also be mentioned that although FIGS. 1, 2, and 3 illustrate additional structure which forms no part of the present invention, such structure serves to provide a proper background for the inventive concept.

Figure 4:
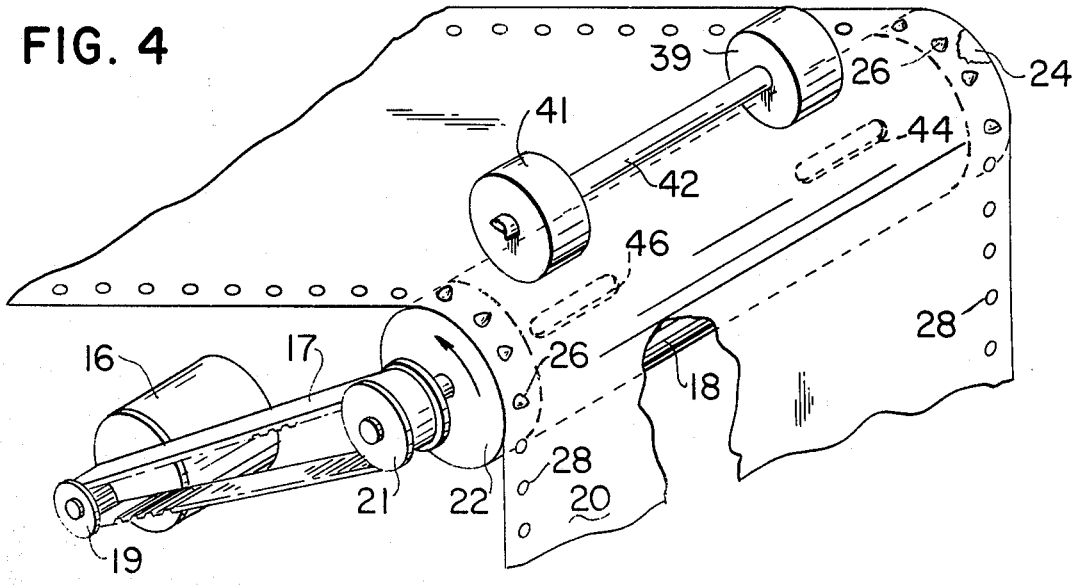
FIG. 4 is a perspective view in somewhat diagrammatic form of the paper drive mechanism.

The paper drive or transport mechanism of the present invention combines the use of a sprocketed drum or roller 18 with the friction drive of pinch rolls through pressure contact thereof with the paper and incorporates means to maintain paper movement in smooth flowing and taut manner wherein the pinch rolls are synchronized with the sprocket wheels. A pair of such pinch rolls 39 and 41, see also FIG. 4, are carried on a shaft 42 suitably journaled in side frames 12 and 14, the pinch rolls 39, 41 being driven by contact with the paper 20 as the paper is driven by the sprocket wheels 22 and 24, as shown in FIGS. 1 and 4. Each of the pinch rolls 39 and 41 may have a frictional coating or surface 43 thereon, whether the rolls are made of metal, plastic or like material.

Figure 5:
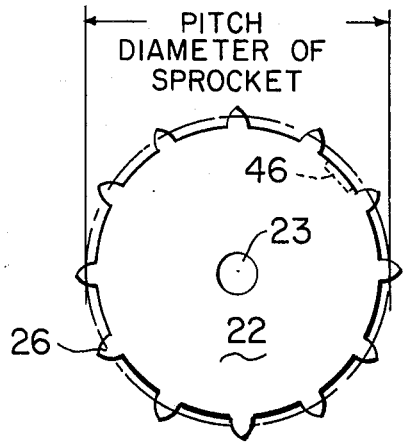
FIG. 5 is an end view of one of the sprocket wheels for driving the paper.
Figure 6:
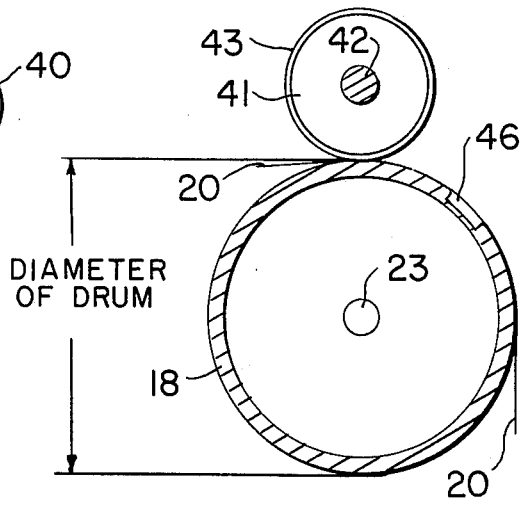
FIG. 6 is a sectional view of the drive drum and one of the pinch rollers taken on the line 6—6 of FIG. 1.

In the case of the sprocket wheels 22 and 24 on the drum 18, it can be seen from FIGS. 5 and 6 that the diameter of the drum 18 is greater than the pitch diameter of the sprocket pins or teeth 26, the effect of this construction being that, as the drive drum 18 is driven at a certain speed of rotation by the motor 16, the belt 17, and the wheels 22 and 24, the paper 20 is actually driven or caused to be advanced by the pinch rolls 39 and 41 at a slightly faster rate. The diameter of the drum 18 is in the order of 0.002 inch larger than the pitch diameter of the sprockets 22 and 24. It is to be expected that the different rates of drive would be accumulative and that an accumulation of the difference would be noticeable for each revolution of the drive drum 18. Although the differences in the drive motion between the drum 18 and the rollers 39, 41 are seen to be of slight nature, the effect is to provide and maintain the paper in a taut condition for the printing operations. As seen in FIGS. 1, 4, and 6, the drive drum 18 includes a pair of voids or slots 44 and 46 therein which are in the path of the pinch rolls 39 and 41, as the rolls engage the paper 20 during the driving thereof. For each revolution of the drive drum 18, and each time the pinch rolls 39, 41 cross over the slots 44, 46, the pressure on the paper 20 by the faster driven pinch rolls 39, 41 is relaxed or eased to enable the sprocket teeth 26 which are engageable with the apertures 28 to catch-up and to cancel out the accumulated difference in the rate of paper advance. This "additive-substractive effect" is repeated for each revolution of the sprocket drum 18 and the paper 20 is maintained in a free flowing and taut manner past the print head 32.

In the particular construction of the mechanism, the circumference of the drive drum 18 is equal to the length of one fold or form of the paper 20, which greatly simplifies the timing procedure or technique, wherein at each moment of pinch roll pressure relief from the paper 20, the transition is made from the most recently printed form or fold to the next successive fold.

It is thus seen that herein shown and described is a paper transport or drive mechanism which provides for proper tension in the paper for a passive-type platen operation and wherein the flow of the paper is smoothly drawn past the print station. Even though the use of a sprocketed drum may be preferable, a drum without sprocket wheels may be used to drive roll-type paper, and while only one embodiment has been disclosed herein, certain other variations may occur to those skilled in the art. It is contemplated that all such variations, not departing from the spirit and scope of the invention, are to be construed in accordance with the following claims.

What is claimed is:

1. Apparatus for advancing record media including first drive means, second drive means interconnected for operation with said first drive means, means for driving said first and second drive means at a selected rate of operation, whereby said second drive means advances said record media at a predetermined rate, friction means juxtaposed said first drive means and operably associated with said record media to cause said record media to be advanced by said first drive means at a rate greater than said predetermined rate, and relief means in said first drive means and operably associated with said friction means for relaxing thereof in relation to said record media at predetermined times during advancement of said record media by said first drive means, said second drive means maintaining advancement of said record media at said predetermined times.

2. The apparatus of claim 1 wherein said first drive means comprises a drum member, and said second drive means comprises at least one sprocket member carried by said drum member, said drum member being of a diameter slightly greater than that of said sprocket member so as to advance said record media at a rate greater than that provided by said sprocket member.

3. The apparatus of claim 2 wherein said friction means comprises a roller member continually urging said record media into driving contact with the periphery of said drum member.

4. Apparatus for advancing record media including drive means having a media first drive portion of one peripheral size and at least one media second drive portion of a peripheral size lesser than that of said first drive portion, means for driving said drive means at a selected rate of operation, means associated with said second drive portion for advancing said record media at a predetermined rate during driving of said drive means, pressure means adjacent said first drive portion and operably associated with said record media to cause said record media to be advanced by said first drive portion during operation of said drive means at a rate greater than said predetermined rate, and relief means in said first drive portion aligned with said pressure means for relaxing thereof with respect to said record media at predetermined times during operation of said drive means, said second drive portion maintaining advancement of said record media during said predetermined times.

5. The apparatus of claim 4 wherein said drive means comprises a cylinder member having first and second diameter portions defining said first and said second drive portions respectively, said means associated with said second drive portion comprises record media drive pins positioned around the periphery of said second diameter portion, and said pressure means comprises a roller member yieldingly urging said record media into driving engagement with said first diameter portion.

6. Record media advancing apparatus including a drive cylinder, means for driving said drive cylinder at one speed of rotation, sprocket means carried by said drive cylinder to advance said record media at a predetermined rate during rotation of said cylinder, pressure means adjacent said drive cylinder and operably associated therewith for causing said record media to be advanced by said drive cylinder during rotation thereof at a rate greater than said predetermined rate, and relief means in said drive cylinder aligned with said pressure means for relaxing thereof in relation to said record media at least once during each rotation of said drive cylinder.

7. The apparatus of claim 6 wherein said pressure means comprise a pair of rollers maintaining driving relationship between said record media and said drive cylinder.

8. The apparatus of claim 6 wherein the diameter of said drive cylinder is greater than the pitch diameter of said sprocket means, and said pressure means comprises at least one roller member yieldingly urging said record media into engagement with the periphery of said drive cylinder.

9. In transport mechanism for advancing record media defining apertures therein, said mechanism comprising a drive roller having at least one sprocket wheel associated therewith and engageable with said apertures and driven with said drive roller at one speed of rotation to advance said record media at a specified rate, and at least one pressure member adjacent said drive roller and engageable with said record media to cause said record media to be advanced by said drive roller at a rate greater than said specified rate, said drive roller defining relief means therein and positioned in the path of said pressure member whereby the engagement of said pressure member with said record media is relaxed upon travel of said pressure member across said relief means for equalizing the driving motion of said record media by said drive roller and said sprocket wheel.

10. In the mechanism of claim 9 wherein said drive roller includes a sprocket wheel at each end thereof for driving said record media and wherein a pair of frictional rollers engage with said record media and are aligned with a pair of spaced slots in the periphery of said drive roller for relaxing record media advancement by said drive roller.

11. In the mechanism of claim 9 wherein the diameter of said drive roller is greater than the pitch diameter of said sprocket wheel and said pressure member causes said record media to be advanced by said drive roller at a rate greater than said specified rate.

12. A method of maintaining record media movement in synchronism between multiple drive means comprising the steps of providing a drive roller of one diameter with sprocketed members having a lesser pitch diameter thereon and slot means in the periphery thereof, driving the drive roller and the sprocketed members at a selected speed of rotation to advance the record media at one rate, and providing pressure members in contact with said record media on the periphery of said drive roller to cause said record media to be advanced at a rate greater than said one rate, said pressure members being positioned in a path to move across said slot means to relax the contact on said record media by said pressure members for each revolution of the drive roller to equalize the rates of record media advancement.

13. A method of transporting record media utilizing multiple drive means comprising the steps of providing a drive roller with sprocket wheels thereon and a pair of slots in the periphery thereof, said drive roller being of greater diameter than the pitch diameter of the sprocket wheels, driving the sprocket wheels and the drive roller at one speed of rotation to transport said record media at a predetermined rate by said sprocket wheels, and providing frictional rollers in pressure contact with said record media to cause said record media to be transported at a rate greater than said predetermined rate, said frictional rollers being aligned with said slot means in said drive roller to roll thereacross for relaxing the pressure contact of said frictional rollers on said record media for each revolution of said drive roller to equalize the rates of record media transport.

* * * * *